US009132537B2

(12) United States Patent
Lai Li

(10) Patent No.: US 9,132,537 B2
(45) Date of Patent: Sep. 15, 2015

(54) TORQUE WRENCH

(71) Applicant: Yu-Lan Lai Li, Taichung (TW)

(72) Inventor: Yu-Lan Lai Li, Taichung (TW)

( * ) Notice: Subject to any disclaimer, the term of this patent is extended or adjusted under 35 U.S.C. 154(b) by 220 days.

(21) Appl. No.: 13/969,645

(22) Filed: Aug. 19, 2013

(65) Prior Publication Data

US 2015/0047476 A1 Feb. 19, 2015

(51) Int. Cl.
*B25B 23/142* (2006.01)

(52) U.S. Cl.
CPC ..... *B25B 23/1427* (2013.01)

(58) Field of Classification Search
CPC ..... B25B 23/1427
See application file for complete search history.

(56) References Cited

U.S. PATENT DOCUMENTS

| | | | | |
|---|---|---|---|---|
| 8,495,935 | B2 * | 7/2013 | Mountz et al. | 81/467 |
| 8,763,500 | B2 * | 7/2014 | Mountz et al. | 81/467 |
| 2011/0023576 | A1 * | 2/2011 | Mountz et al. | 73/1.12 |

* cited by examiner

*Primary Examiner* — David B Thomas
(74) *Attorney, Agent, or Firm* — Alan D. Kamrath; Kamrath IP Lawfirm, P.A.

(57) ABSTRACT

A torque wrench, a torque wrench contains a hollowing extension, a tool head, a torque adjusting mechanism, a controlling member, and a value adjusting device. The tool head connects with a first end of the hollow extension, the torque adjusting mechanism includes a first end coupling with a second end of the hollow extension, the controlling member connects with a second end of the torque adjusting mechanism. The value displaying device couples with the controlling member and includes a housing, a plurality of digital wheels mounted in the housing, a central shaft, and a plurality of driving gears, wherein the central shaft inserts through the plurality of driving gears, each driving gear meshes with one side of a respective one of the plurality of digital wheels so as to drive the respective one of the plurality of digital wheels.

7 Claims, 5 Drawing Sheets

TORQUE WRENCH

FIELD OF THE INVENTION

The present invention relates to a torque wrench which is capable of adjusting a torque value.

BACKGROUND OF THE INVENTION

A conventional torque wrench is adjusted to set a desired torque value, and when an operating force is over a set torque value, the torque wrench makes sounds to remind a user. The conventional torque wrench contains a rotatable controlling member for driving a screw rod fixed in an extension of the torque wrench to rotate, and then a sliding block screwed with the screw rod moves to different positions so that a spring is pressed by the sliding block to adjust a torque value.

The torque value is displayed by the following types:

1. A numerical scale is marked on a handle of the torque wrench, but a size of an outer peripheral side of the handle is limited, for example, only some linear scales and larger torque values are marked on the outer peripheral side of the handle, so a precise scale cannot be marked on the handle.

2. The torque wrench is provided with a battery to display the torque value electronically, but the battery has to be replaced after a period of using time.

The present invention has arisen to mitigate and/or obviate the afore-described disadvantages.

SUMMARY OF THE INVENTION

The primary object of the present invention is to provide a torque wrench which when rotating a controlling member to drive a plurality of digital wheels in turn, a torque value of a torque wrench is adjusted.

Another object of the present invention is to provide a torque wrench in which a plurality of digital wheels, a central shaft, and a plurality of driving gears are mechanical parts, so a service life of the torque wrench is prolonged without replacing battery.

DETAILED DESCRIPTION OF THE PREFERRED EMBODIMENTS

Figure 1:
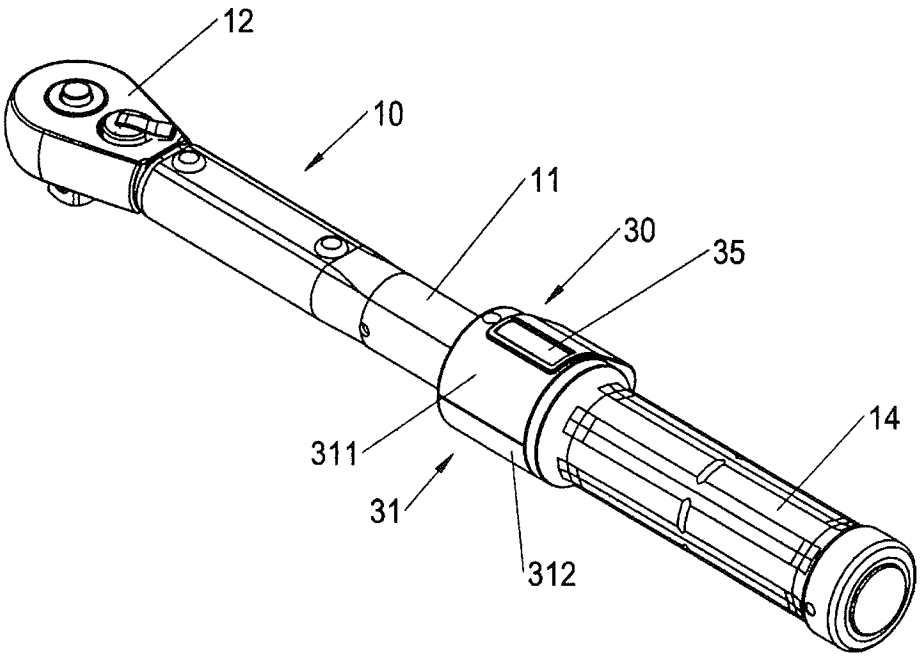
FIG. 1 is a perspective view showing the assembly of a torque wrench according to a preferred embodiment of the present invention.
Figure 2:
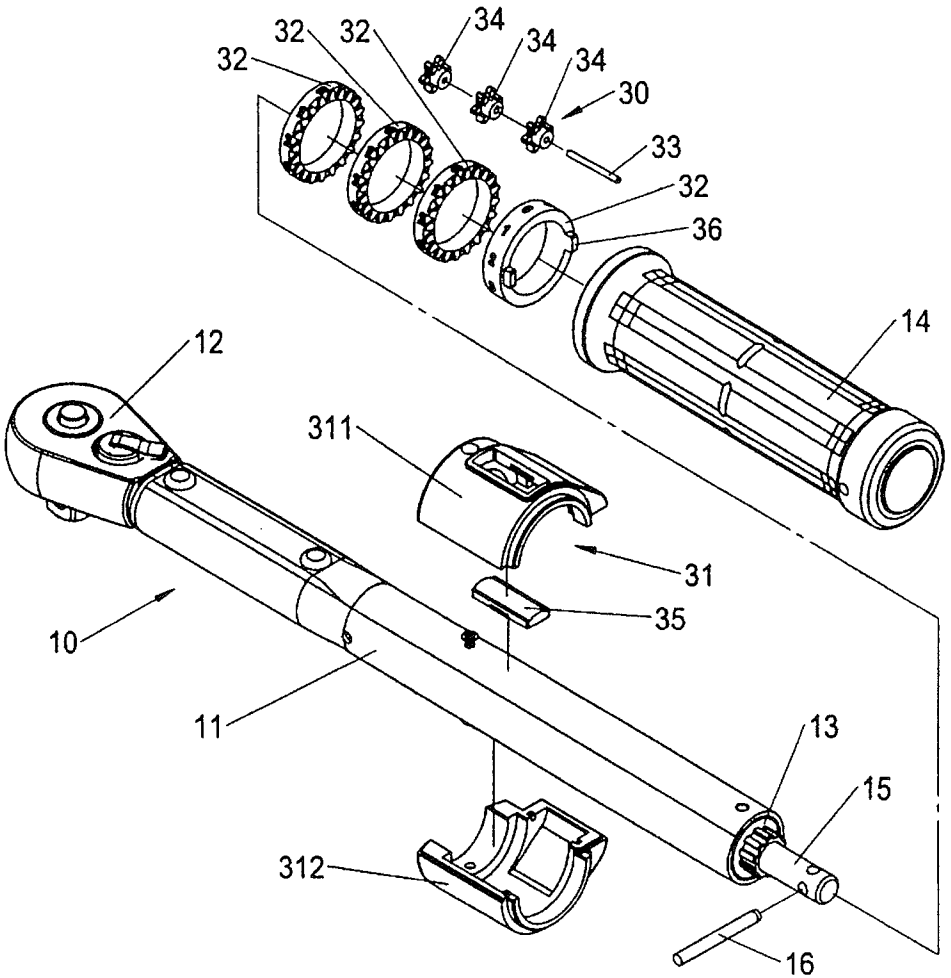
FIG. 2 is a perspective view showing the exploded component of a part of the torque wrench according to the preferred embodiment of the present invention.
Figure 3:
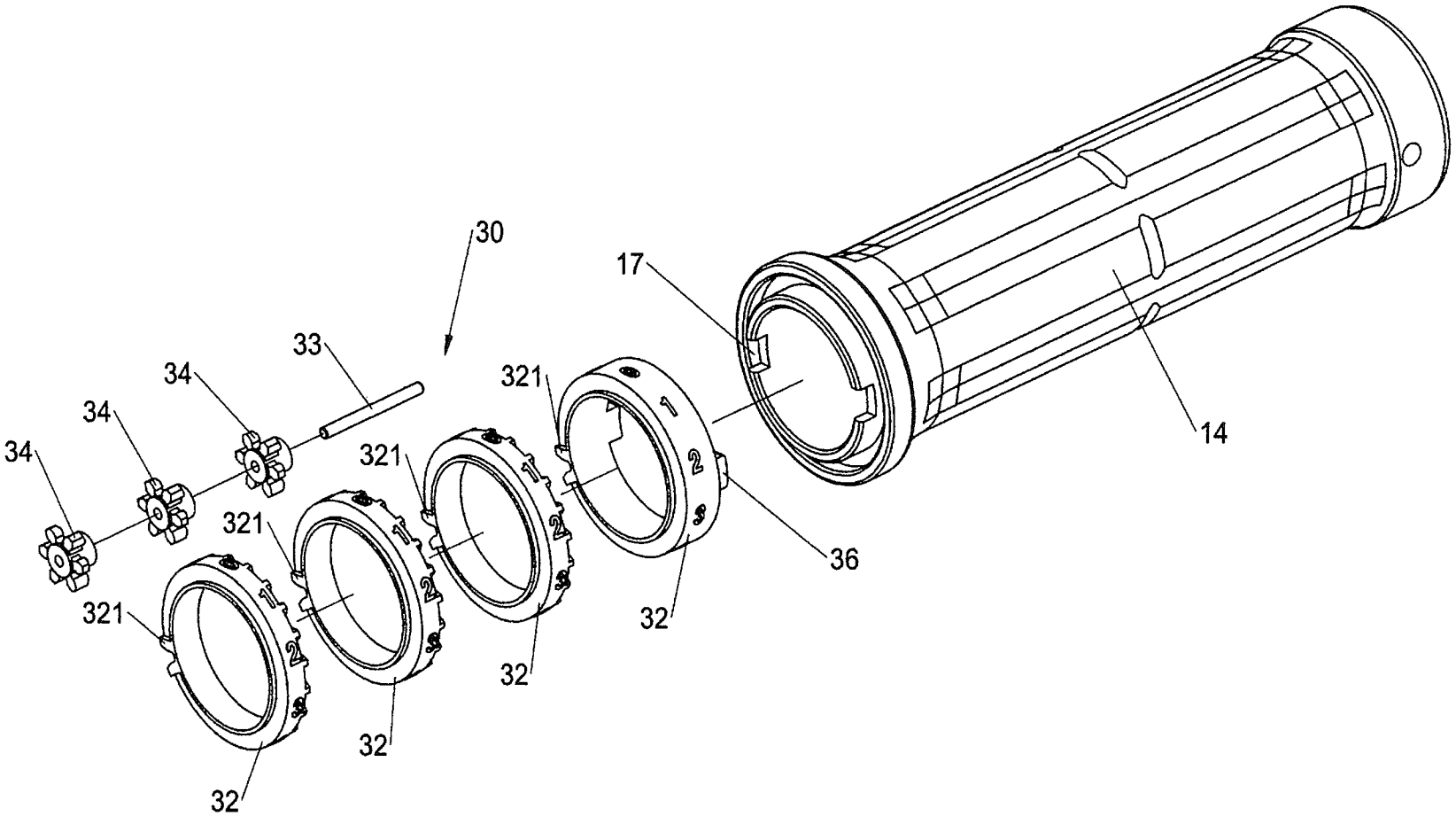
FIG. 3 is a perspective view showing the exploded components of a plurality of digital wheels and driving gears of the torque wrench according to the preferred embodiment of the present invention.
Figure 4:
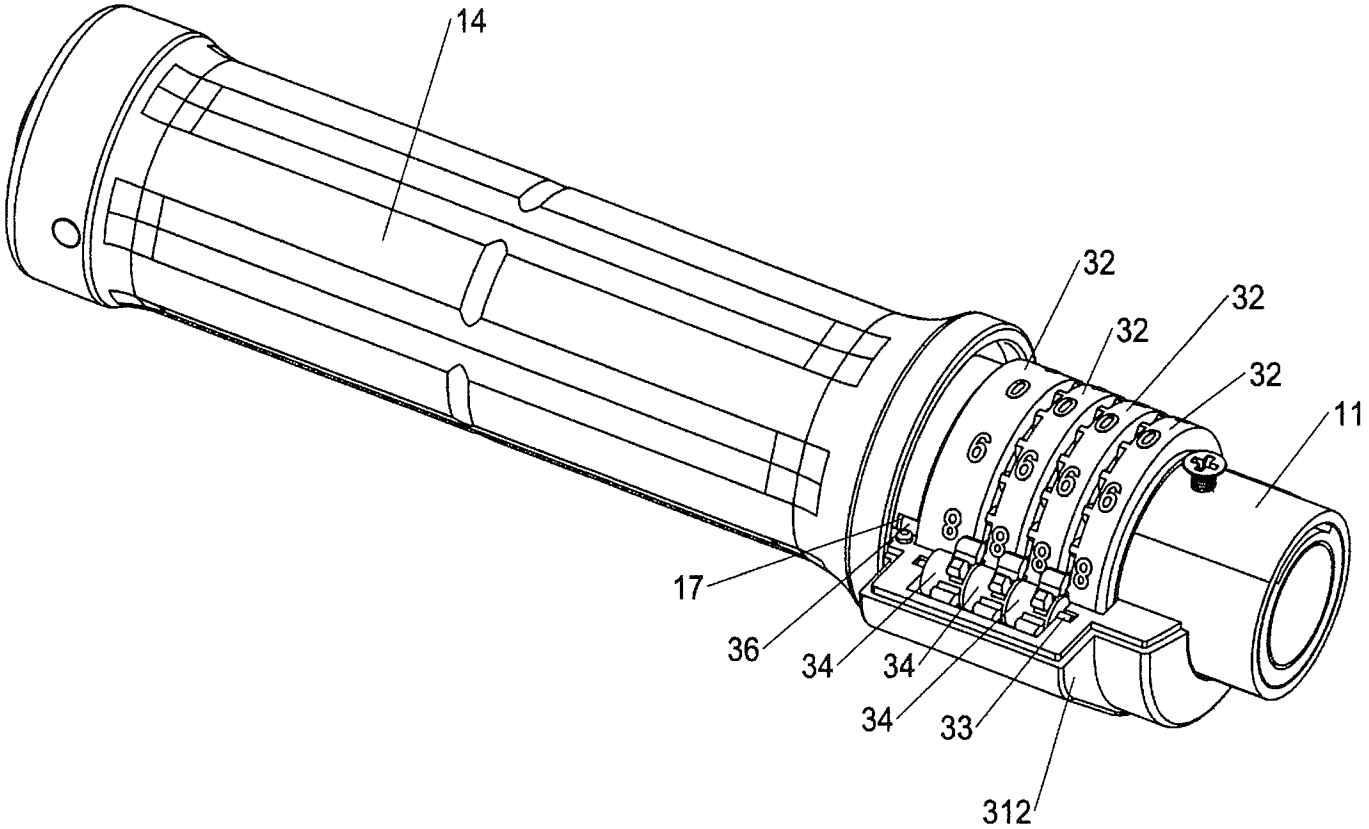
FIG. 4 is a perspective view showing the assembly of a value displaying device of the torque wrench according to the preferred embodiment of the present invention.
Figure 5:
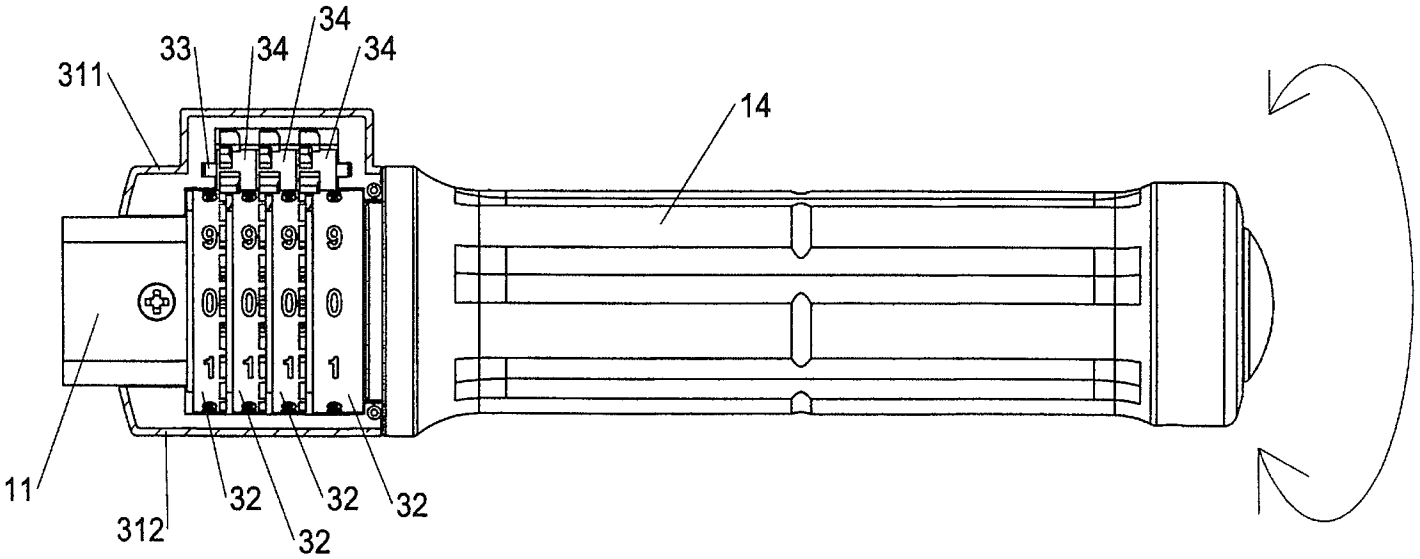
FIG. 5 is a plane view showing the assembly of the value displaying device of the torque wrench according to the preferred embodiment of the present invention.

With reference to FIGS. 1-5, a torque wrench 10 according to a preferred embodiment of the present invention comprises: a hollow extension 11, a tool head 12 connecting with a first end of the hollow extension 11, a torque adjusting mechanism 13 including a first end coupling with a second end of the hollow extension 11, a controlling member 14 connecting with a second end of the torque adjusting mechanism 13; the torque wrench 10 also comprises a value displaying device 30 disposed thereon and coupling with the controlling member 14, and the value displaying device 30 including a housing 31, a plurality of digital wheels 32 mounted in the housing 31, a central shaft 33, and a plurality of driving gears 34, wherein the central shaft 33 inserts through the plurality of driving gears 34, each driving gear 34 meshes with one side of a respective one of the plurality of digital wheels 32 so as to drive the respective one of the plurality of digital wheels 32.

The central shaft 33 is mounted in one side of an inner wall of the housing 31.

The housing 31 has a transplant window 35 arranged on an outer wall thereof.

The housing 31 also has an upper cap 311 and a lower cap 312, and the upper cap 311 and the lower cap 312 cover together on the hollow extension 11 of the torque wrench 10.

In addition, the torque adjusting mechanism 13 has a screw rod 15 and a post 16 inserted through one end of the screw rod 15 and connecting with the controlling member 14, and the controlling member 14 is hollow and has at least one recess 17 defined around one end thereof, wherein the controlling member 14 is fitted onto the hollow extension 11 of the torque wrench 10. Each digital wheel 32 is formed in a ring shape and defined among the hollow extension 11, the controlling member 14, and the housing 31, wherein each digital wheel 32 has a toothed portion 321 formed at a predetermined position of an outer side thereof and meshing with a respective one of the plurality of driving gears 34, wherein one of the plurality of digital wheels 32, which is closest to the controlling member 12, has at least one protrusion 36 facing to the controlling member 14 so as to retain with the at least one recess 17, such that the value displaying device 30 is driven by the plurality of digital wheels 32 and the controlling member 14.

Preferably, the controlling member 14 is formed in a hollow handle shape.

When rotating the controlling member 14, the torque adjusting mechanism 13 is adjusted by the controlling member 14, and the at least one protrusion 36 retains with the at least one recess 17 so as to drive one digital wheel 32 which is closest to the controlling member 14 to rotate, and a toothed portion 321 of the one digital wheel 32 drives one of the plural driving gears 34 which meshes with the one digital wheel 32 to rotate so that the one driving gear 34 drives another distal wheel 32 which contacts with the one digital wheel 32 to rotate, and then the other distal wheel 32 is driven by another distal wheel 32, thus adjusting torque value of the torque wrench.

Thereby, the torque wrench of the present invention has the following advantages:

1. When rotating the controlling member 14 to drive the plurality of digital wheels 32 in turn, the torque value of the torque wrench is adjusted.

2. Due to the plurality of digital wheels 32, the central shaft 33, and the plurality of driving gears 34 are mechanical parts, a service life of the torque wrench is prolonged without replacing battery.

While the preferred embodiments of the invention have been set forth for the purpose of disclosure, modifications of the disclosed embodiments of the invention as well as other embodiments thereof may occur to those skilled in the art.

Accordingly, the appended claims are intended to cover all embodiments which do not depart from the spirit and scope of the invention.

What is claimed is:

1. A torque wrench comprising:

a hollow extension, a tool head connecting with a first end of the hollow extension, a torque adjusting mechanism including a first end coupling with a second end of the hollow extension, a controlling member connecting with a second end of the torque adjusting mechanism;

a value displaying device disposed there on a torque wrench and coupling with the controlling member, and the value displaying device including a housing, a plurality of digital wheels mounted in the housing, a central shaft, and a plurality of driving gears, wherein the central shaft inserts through the plurality of driving gears, each driving gear meshes with one side of a respective one of the plurality of digital wheels so as to drive the respective one of the plurality of digital wheels.

2. The torque wrench as claimed in claim 1, wherein the central shaft is mounted in one side of an inner wall of the housing.

3. The torque wrench as claimed in claim 1, wherein the housing has a transplant window arranged on an outer wall thereof.

4. The torque wrench as claimed in claim 1, wherein the housing also has an upper cap and a lower cap, and the upper cap and the lower cap cover together on the hollow extension of the torque wrench.

5. The torque wrench as claimed in claim 1, wherein the torque adjusting mechanism has a screw rod and a post inserted through one end of the screw rod and connecting with the controlling member, and the controlling member is hollow and has at least one recess defined around one end thereof, wherein the controlling member is fitted onto the hollow extension of the torque wrench, and each digital wheel is formed in a ring shape and defined among the hollow extension, the controlling member, and the housing, and wherein each digital wheel has a toothed portion formed at a predetermined position of an outer side thereof and meshing with a respective one of the plurality of driving gears, wherein one of the plurality of digital wheels, which is closest to the controlling member, has at least one protrusion facing to the controlling member so as to retain with the at least one recess, such that the value displaying device is driven by the plurality of digital wheels and the controlling member.

6. The torque wrench as claimed in claim 5, wherein the controlling member is formed in a hollow handle shape.

7. The torque wrench as claimed in claim 1, wherein the controlling member is formed in a hollow handle shape.

* * * * *